United States Patent [19]

Davydov et al.

[11] 4,255,957

[45] Mar. 17, 1981

[54] MACHINE FOR MULTIDIE NONSLIP DRAWING OF WIRE PRODUCTS

[76] Inventors: Vadim A. Davydov, ulitsa Mikhailova, 29, korpus 3, kv. 57; Vladimir I. Khromov, Leninsky prospekt, 26, kv. 34; Aizik M. Kogos, ulitsa Fedora Poletaeva, 24, korpus 2, kv. 50, all of Moscow; Leonid I. Rymarenko, prospekt Lenina, 10a, kv. 28, Balashikha Moskovskoi oblasti; Igor M. Makeev, Frunzenskaya naberezhnaya, 36, kv. 227; Nikolai V. Pasechnik, prospekt Mira, 188, kv. 60, both of Moscow, all of U.S.S.R.

[21] Appl. No.: 961,392

[22] Filed: Nov. 16, 1978

[51] Int. Cl.[3] ..... B21C 1/04

[52] U.S. Cl. ..... 72/279; 72/281

[58] Field of Search ..... 72/279, 280, 281, 288, 72/289; 60/352, 358

[56] References Cited

U.S. PATENT DOCUMENTS

| | | | |
|---|---|---|---|
| 604,769 | 5/1898 | Lamb | 72/279 |
| 2,960,215 | 11/1960 | Rehnquist | 72/279 |
| 3,677,004 | 7/1972 | Muller et al. | 60/352 |

*Primary Examiner*—Milton S. Mehr

*Attorney, Agent, or Firm*—Lackenbach, Lilling & Siegel

[57] ABSTRACT

A machine comprises draw blocks grouped in units arranged coaxially and mounted on coaxially located shafts of multiturbine hydraulic transformers. The drive of the machine is an asynchronous electric motor combined with a multiturbine hydraulic transformer.

6 Claims, 5 Drawing Figures

MACHINE FOR MULTIDIE NONSLIP DRAWING OF WIRE PRODUCTS

BACKGROUND OF THE INVENTION

1. Field of the Application

The invention relates to the manufacture of metal wire, and more particularly, to machines for multidie nonslip drawing of wire products.

The invention is applicable to dry or wet drawing of wire and other products from various metals and alloys.

2. Description of the Prior Art

There are known several types of machines for multidie drawing, which operate with no slipping of wire on draw blocks.

These types include looping back-pull drawing machines, double-deck machines and cumulative type wire-drawing machines.

For example, there is known a machine for multidie nonslip drawing, developed by the firm Reinking Maschinenbau, with a drive composed of a standard three-phase electric motor and a positive-displacement hydraulic pump (see "Stahl und Eisen", 1976, no. 1 9, p. 927). The machine has a number of draw blocks driven from regulated hydraulic motors, die-head blocks with dies being mounted in front of each draw block, the drawing speed being continuously adjustable between zero and the maximum value.

The drawing speed is adjusted by means of a governor which varies the speed as a function of drawing forces at constant power input.

In this manner, the drawing speed for wire of any diameter sets itself at a maximum value determined by the power rating of the motor. The machine is provided with individual drives for each draw block.

Among the disadvantages of the aforementioned machine are:

the necessity for individual re-adjustment of each hydraulic motor on change of drawing route; large size of the machine because of the individual drives for each draw block; large metal requirements for manufacturing the machine; small drawing speeds and short service life of the positive-displacement hydraulic drive.

There is known a multidie nonslip cumulative drawing machine with wire storage on draw blocks. The machine comprises several draw blocks, each mounted on a separate shaft and coupled to a hydraulic transmission, or a hydraulic clutch, placed on the shaft of an asynchronous electric motor. Die-head blocks with dies are arranged in front of each draw block. The machine is equipped with decoiling and coiling devices.

The disadvantages of the machine described above are as follows: each drawing unit is complex and bulky because of a large number of series-arranged elements of the draw block drive components, large overall dimensions of the drawing machine because of individually driven draw blocks, large metal requirement for manufacturing the machine; no engaging speed, so that a wire is engaged by operating the machine in inching duty; inclusion of gear boxes in the drive of each draw block, which requires individual re-adjustment of the gear boxes when changing over to other drawing speeds.

Many types of hydraulic transformers have been proposed, wherein the speed of the output shaft is governed by actuating a valve which shuts off a flow of liquid in a circulation circuit (see, for example, B. A. Gavrilenko and I. F. Semichastnov, "Hydrodynamic Clutches and Transformers" /in Russian/, Moscow, "Machinostroeniye" Publishers, 1969, p. 283).

Among other known types of hydraulic transformers, one closely similar in engineering arrangement is a hydraulic transformer employed in a hydraulic reversible transmission according to U.S. Pat. No. 3,677,004 (FIG. 6).

The valve placed inside a cavity of the hydraulic transformer and shutting off the flow of the liquid in the circulation circuit, is connected to rods of several hydraulic cylinders arranged circularly with respect to the axis of rotation of elements of the hydraulic transformer. Rod cavities of the hydraulic cylinders communicate with the cavity of the hydraulic transformer, so that the pressure of the liquid acts upon the valve and the pistons of the hydraulic cylinders to maintain the valve open, this action being supported by springs placed in the rod cavities of the hydraulic cylinders.

The motion of the valve is controlled by supplying the liquid into the piston cavity from an independent source. The disadvantage inherent in said hydraulic transformer are: inclusion of several hydraulic cylinder actuators; non-simultaneous motion of all the hydraulic cylinders; complicated design; the valve opens when the controlling pressure is removed, this resulting, when the motor is in operation, in a rotation of the output shaft, which presents a measure of hazard; necessity for an extraneous source of the working liquid under pressure for controlling said valve.

SUMMARY OF THE INVENTION

The primary object of this invention is to provide a machine for multidie nonslip drawing of wire products having substantially smaller overall dimensions and, accordingly, occupying a lesser floorspace as compared to existing machines for similar applications.

Another no less important object of the invention is to reduce the metal requirement for manufacturing the machine.

Still another major object of the invention is to simplify the electric drive and the automation of the machine.

Yet another object of the present invention is to simplify the machine control system.

A further object of the invention is to enhance the reliability and service life of the machine drive.

An object of the invention is to lower the machine manufacturing costs.

An additional object of the invention is to minimize the machine operating costs.

Yet another major object of the invention is to increase the efficiency of the machine.

Yet a further object of the invention is to provide means for smooth acceleration and deceleration of materials being drawn.

Still a further major object of the invention is to improve the product quality.

Yet an additional object of the invention is to refine the design of the machine to simplify wet nonslip drawing of products on draw blocks.

The above and other objects of the invention are attained in a machine for multidie nonslip drawing of wire products comprising decoiling and coiling devices, arranged along the flow of the production process with respect to a bed which carries die-head blocks with dies and draw blocks, each of which is mounted on a separate shaft geared to a motor by means of a hydrodynamic transmission consisting of a turbine wheel. The machine, according to the invention, has the draw blocks grouped in units, in each of which said draw blocks are arranged coaxially, whereas the shafts of said draw blocks are placed coaxially, the hydrodynamic transmission of each block being formed with a multiturbine hydraulic transformer, each turbine wheel thereof being mounted on one end of the shaft opposite to that carrying the draw block.

Such structural arrangement of the machine for multidie nonslip drawing of wire products makes it possible to make the machine compact, to reduce the number of drive motors, to reduce the metal requirement for the manufacture of the machine, to substantially lower the weight of rotating elements of the draw block drive, to eliminate the action upon the draw blocks of the rotating masses of the drive motor rotor because of insufficiently rigid coupling of the driving and the driven shafts.

With the machine of the invention it becomes possible to carry out over a wide range an automatic levelling of the back-pull of a wire on the draw blocks due to a mechanical coupling of all the draw blocks effected by the wire being drawn.

In addition, the machine of the invention has a relatively long service life, since the hydrodynamic transmission incorporates no rubbing elements, except for bearings and seals, exhibits excellent reliability, as the number of transmission elements between the drive and the draw blocks has been minimized and is protected against overloads, as the energy from the driving shaft to the driven mechanisms is transmitted through the agency of a liquid, this simplifying the operation of the machine and lowering the running costs.

The design of the machine facilitates the wet drawing of wire, enhances the speed of drawing and, accordingly, the efficiency of the machine, while improving the quality of products.

Each multiturbine hydraulic transformer can be fitted with bypass piping communicating with the inlets into the turbine wheels of the hydraulic transformer, said pipings having built-in adjusting throttle valves.

This expands the technological potentialities of the machine. Thus, while maintaining unchanged the total power input to the draw blocks, it becomes possible to redistribute the power input among the draw blocks of the unit and so adjust the back-pull of the wire on the draw blocks. This adjustment, taking into account the steep characteristics of the turbine drive, makes it possible to adjust the back-pull on all the draw blocks of the unit and thus increase the number of wire drawing routes.

It is desirable to communicate the by-pass piping of one multiturbine hydraulic transformer with the corresponding by-pass piping of another multiturbine hydraulic transformer.

This makes possible the re-distribution of the power input among all the turbines of the machine and, in consequence, the simultaneous re-adjustment of the wire back-pull on all the draw blocks.

It is preferable to provide each multiturbine hydraulic transformer with a valve shutting off the flow of liquid in the working cavity of said hydraulic transformer and having rods pivotally connected to a leverage geared to a rod of the hydraulic cylinder actuator, the rod cavity thereof communicating via a throttle valve and a nonreturn valve with the working cavity of one of the multiturbine hydraulic transformers, whereas the rodless cavity of the hydraulic cylinder actuator is connected by two two-position distribution valves to said working cavity of the multiturbine hydraulic transformer and to the discharge piping, controlled by a throttle valve, and also communicates directly with said discharge piping.

This engineering solution makes it possible to employ a hydraulic transformer as a source of pressure, the valves then automatically closing and no power being supplied to the draw blocks, when the hydraulic transformer electric motors are switched on. Consequently, the energizing of the main drive automatically prepares the machine control system for operation and ensures safe working conditions. This is achieved by the active surface area of the piston in the rod cavity of the hydraulic which is made greater than the total surface area, which is acted upon by the pressure of the liquid, of the rods of the hydraulic transformer annular valves.

As the rods of the annular valves and the rods of the hydraulic cylinder are coupled to a common leverage, it is possible to simultaneously open the valves of the hydraulic transformers, the energizing of the two-position distribution valve, directly connected to a piston cavity of the hydraulic cylinder, causing a smooth opening of the annular valves at a given rate effected by the adjusting throttle valve, whereas the energizing of the other distribution valve results in a smooth closing of the valves at a given rate governed by yet another adjusting throttle valve. Accordingly, the draw blocks of the machine are accelerated and decelerated smoothly. All this simplifies the control of the machine.

It is useful to provide the housing of each multiturbine hydraulic transformer with a pin for stopping the draw blocks and with an actuator for reciprocating said pin inside slots arranged in turbine wheel disks.

The design of the machine makes it possible to stop the turbine wheels of the draw blocks that are free from wire. When wire is engaged into the upstream draw blocks, said wheels are subsequently released by moving the pin. This facilitates the engagement of the wire into dogs placed in the draw blocks and ensures safe working conditions when engaging a wire into the machine.

It is preferable to build into the body of each draw block the dogs for gripping wire, said dogs comprising gripping jaws, one of which is wedge-shaped and provided with a mechanism for a longitudinal motion in the direction for gripping the wire, whereas the other jaw should be advantageously shaped as a cylinder with a transversal groove to receive the former jaw and be mounted in the body of the draw block for rotation about its longitudinal axis, which is perpendicular to the direction of motion of the former jaw.

This engineering solution simplifies the dog mechanism used therein, ensures a reliable attachment of the tapered end of wire, facilitates the work of the drawer and provides safe conditions for engaging a wire into the machine each time said wire snaps.

BRIEF DESCRIPTION OF THE DRAWINGS

These and other objects and features of the invention become readily apparent from one embodiment thereof which will now be described by way of example with reference to the accompanying drawings, in which.

DESCRIPTION OF THE PREFERRED EMBODIMENT

Figure 1:
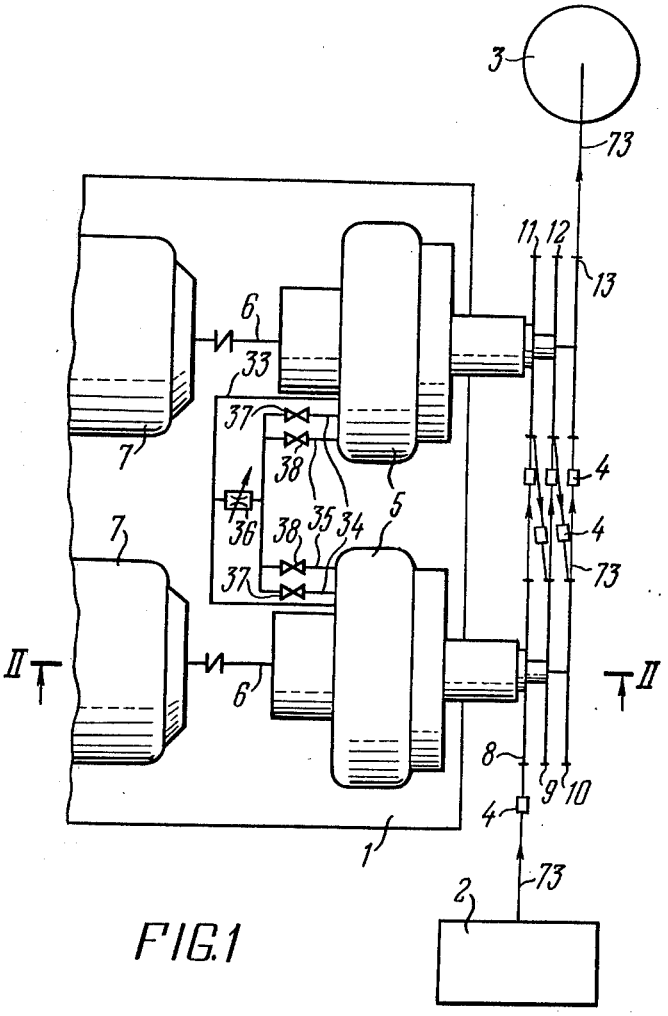
FIG. 1 is a diagrammatic plan view of a machine for multidie nonslip drawing of wire products, according to the invention.

Referring now to the above drawings, there is shown therein a machine for multidie nonslip drawing of wire products which comprises a bed 1 (FIG. 1) mounted on a foundation, a decoiling device 2 and a coiling device 3, placed respectively in front and back of the bed 1 along the flow of the production process. The bed 1 carries die-head blocks with dies 4 and multiturbine hydraulic transformers 5 whose input shafts 6 are geared to drive asynchronous electric motors 7.

Draw blocks 8, 9, 10, 11, 12 and 13 are grouped into two units of three draw blocks each corresponding to the two hydraulic transformers 5, the first unit comprising the draw blocks 8, 9 and 10, and the second unit, the draw blocks 11, 12 and 13. Each draw block of one unit is mounted on a respective output shaft of the multiturbine hydraulic transformer 5. Thus, the draw block 8 is attached to the output shaft 14 (FIG. 2), the draw block 9, to the shaft 15, and the draw block 10, to the shaft 16.

A hollow shaft 14 is secured in the housing of the hydraulic transformer 5 in bearing 17 and 18, and a hollow shaft 15 is placed inside a cavity of the shaft 14 in bearings 19 and 20, whereas a shaft 16 is arranged inside a cavity of the shaft 15 in bearings 21 and 22. The draw blocks of a single unit are coaxial, and the shafts of said draw blocks are coaxial with respect to one another. The ends of each shaft, located inside an encompassing shaft, project beyond the limits of the latter.

A pump well 24, turbine wheels 25, 26 and 27, stators 28, 29 and 30 are placed inside a working cavity 23 of the multidie hydraulic transformer 5.

The pump wheel 24 is mounted on the input shaft 6 placed in the housing of the multiturbine hydraulic transformer 5 in bearings 31 and 32.

The turbine wheel 25 is rigidly secured on the output shaft 16, and the turbine wheel 26, on the output shaft 15, and the turbine wheel 27, on the output shaft 14. The stators 28, 29 and 30 are fixed in the housing of the multiturbine hydraulic transformer 5. Each hydraulic transformer 5 is provide with bypass pipings 33, 34 and 35 (FIGS. 1 and 2) communicating one to another, bypassing the circulation circuit, the inlets to its turbine wheels 25, 26 and 27 (FIG. 2). The bypass pipings 33 of both multiturbine hydraulic transformers 5 are connected to one another and have a common adjusting throttle valve 36. The bypass pipings 34 and 35 are provided with setting-up throttle valves 37 and 38. Internal leakage of the working liquid between the turbine wheels 25, 26 and 27 is eliminted by plate seals 39, 40 and 41.

Each miltiturbine hydraulic transformer 5 is fitted with an adjustable annular valve 42 (FIGS. 2 and 3) located inside its working cavity 23. The power transmitted by the hydraulic transformer 5 can be adjusted with the aid of the valve 42 which acts upon the flow of the liquid in the working cavity 23. The annular valve 42 is secured to two rods 43 (FIG. 3) mounted in the housing of the multiturbine hydraulic transformer 5 for axial motion in guides 44. The other ends of the rods 43 of the two hydraulic transformers 5 are coupled to a leverage 46 which is mounted in bearings 45 and connected to a rod 47 of a hydraulic cylinder actuator 48. A rod cavity 49 of the hydraulic cylinder actuator 48 communicates with the cavity 23 of the hydraulic transformer 5 by means of an adjusting throttle valve 50 and a nonreturn valve 51. A rodless cavity 52 of the hydraulic cylinder actuator 48 communicates directly with the cavity 23 of the hydraulic transformer 5 having a discharge piping 53 and with said discharge piping 53 via an adjusting throttle valve 54 by means of two two-position solenoid distribution valves 55 and 56. The leverage 46 is provided with a grip 57 for manual operation of the valves 42.

Each multiturbine hydraulic transformer 5 incorporates a pin 58 (FIG. 2) mounted in the housing of said hydraulic transformer in guides 59 and 60 for axial motion by means of actuator 61. Disks 62, 63, 64 of respectively the turbine wheels 25, 26 and 27 are provided with slots (holes) 65, 66 and 67 which the pin 58 engages to stop the draw blocks 8, 9 and 10.

Each draw block 8, 9, 10, 11, 12 and 13 (FIG. 3) has built-in dogs 68 (FIGS. 4 and 5) comprising two jaws 69 and 70, a spring 71 (FIG. 5) for spring-loading the jaws and a detachable grip 72 which is operated to release one end of a wire 73. The jaw 69 is shaped as a cylinder inserted freely into a cylindrical recess 74 (FIG. 4) provided in the body of the draw block 10. The jaw 70, having a bevelled end, engages a groove 75 of the jaw 69.

The machine according to the invention for multidie nonslip drawing of wire products operates in the manner below.

Figure 2:
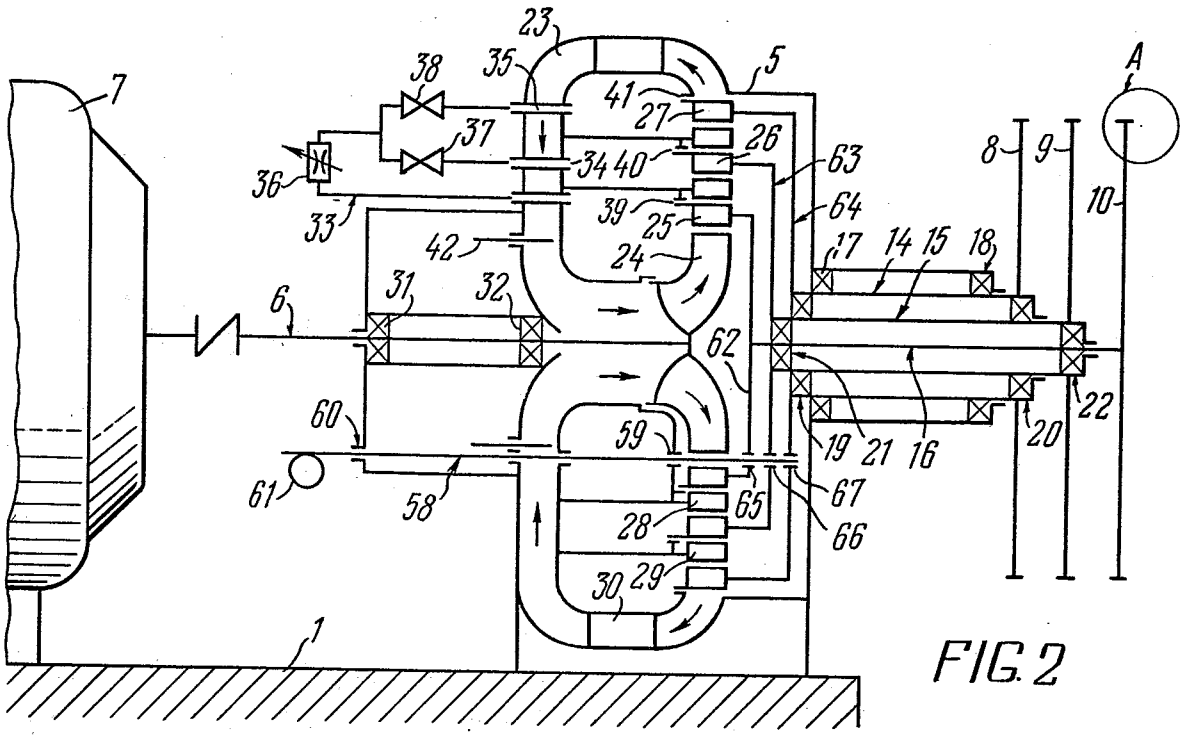
FIG. 2 is a cross section at II—II of the draw block unit of FIG. 1.
Figure 5:
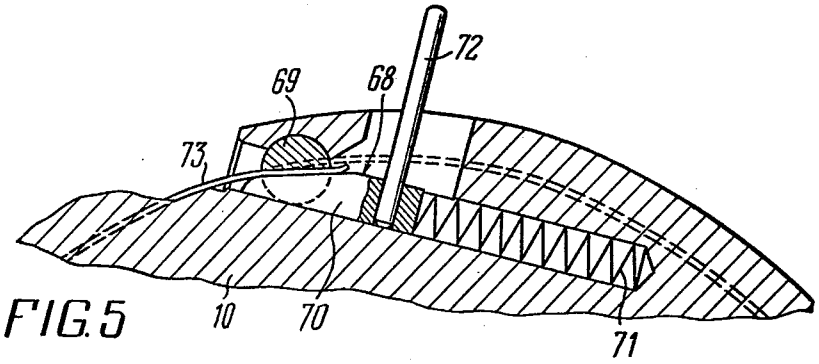
FIG. 5 is a section at V—V of FIG. 4.
Figure 4:
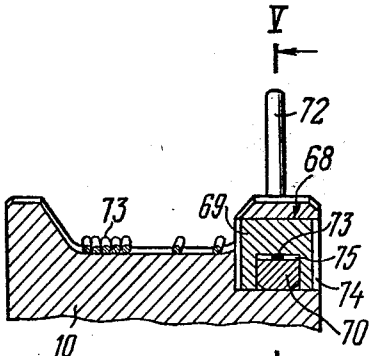
FIG. 4 is an enlarged scale view of a subassembly A of FIG. 2 as a wire is being wound on a draw block.

Prior to starting the operation, the wire 73 is threaded into the machine (FIGS. 1, 4 and 5). To this end, several turns of the wire 73 are taken off the decoiling device 2 (FIG. 1), the end of the wire 73 is pointed, passed through the first die 4 and secured in the dogs 68 (FIG. 4) mounted in the body of the draw block 8 (FIG. 1). At the same time, the detachable grip 72 is operated manually to compress the spring 71. As a result a gap is formed between the jaws 69 and 70 in the groove 75 (FIG. 4), the end of the wire 73 is inserted into said gap, the grip 72 is released, and the end of the wire 73 is clamped by the spring 71 (FIG. 5), after which the grip 72 is removed.

The asynchronous electric motors 7 (FIG. 2) are energized with the annular valves 42 closed and the draw blocks 8, 9, 10 and 11, 12, 13 stopped by the pin 58, thus automatically preparing the electro-hydro-mechanical control system for operation.

With the electric motors 7 energized, the working liquid under pressure circulates in the cavities 23 (FIG. 3) of the multiturbine hydraulic transformers 5 and acts upon the rods 43 with a force in direct ratio to their cross sectional areas to open the valves 42. As the rods 43 of the valves 42 and the rod 47 of the hydraulic cylinder actuator 48 are interconnected by the leverage 46 and the cavity 49 of the hydraulic cylinder actuator 48 is under the same pressure of the working liquid as the rods 43 and since the area of the rod cavity 49 is greater than the sum total of the cross sectional areas of the rods 43, the hydraulic cylinder actuator 48 maintains the valves 42 closed. Therefore, when the electric motors 7 are energized, the draw blocks 8, 9, 10 and 11, 12, 13 remain stationary and are not supplied with power, the solenoids of the distribution valves 55 and 56 then being in the OFF position.

Once a wire is engaged into the first draw block 8, and subsequently into the downstream ones, said block 8 is released by moving the pin 58 (FIG. 2) with the aid of the actuator 61 and energized, while opening the annular valve 42 through manual operation of the grip 57 (FIG. 3) of the leverage 46, the wire 73 then being wound on the block 8 (FIG. 1) at very low speed. In case of rupture of the wire 73, it suffices to release the grip 57 (FIG. 3), and the valve 42 will discontinue the supply of power to the block 8 under the action of the liquid pressure.

Once a sufficient number of turns of the wire 73 (FIG. 1) have been wound on the block 8, the valve 42 (FIG. 3) is closed, several turns of the wire 73 are taken off the block 8 (FIG. 1), said wire is pointed and passed through the second die 4, the end of the wire 73 being clamped, similarly to the manner described for the block 8, in dogs 68 (FIG. 4) mounted on the next in line, along the flow of the production process, draw block 11 (FIG. 1). The draw block 11 is then released, the valves 42 (FIG. 3) are slightly opened, and the wire 73 is wound manually on said draw block 11.

Should, after the drawing of the wire 73 in the second die 4, a loop be formed between the draw block 8 and the second die 4 during the threading operation, the working liquid is bypassed between the turbines outside of the cavity 23 by means of the adjusting throttle valve 36 in a manner to obtain the required pull on the wire 73 (FIG. 1) on said section.

Subsequently, similar operations are performed on the downstream draw blocks 9, 12, 10 and 13 to thread the wire throughout the machine.

Depending on the drawing route, the wire may be engaged into all the six or five, except the last one 13, draw blocks.

Next, the end of the wire 73 is engaged into the coiling device 3, the drive thereof is energized to provide a necessary pull between the last drum 10 or 13 and the coiling device 3.

Figure 3:
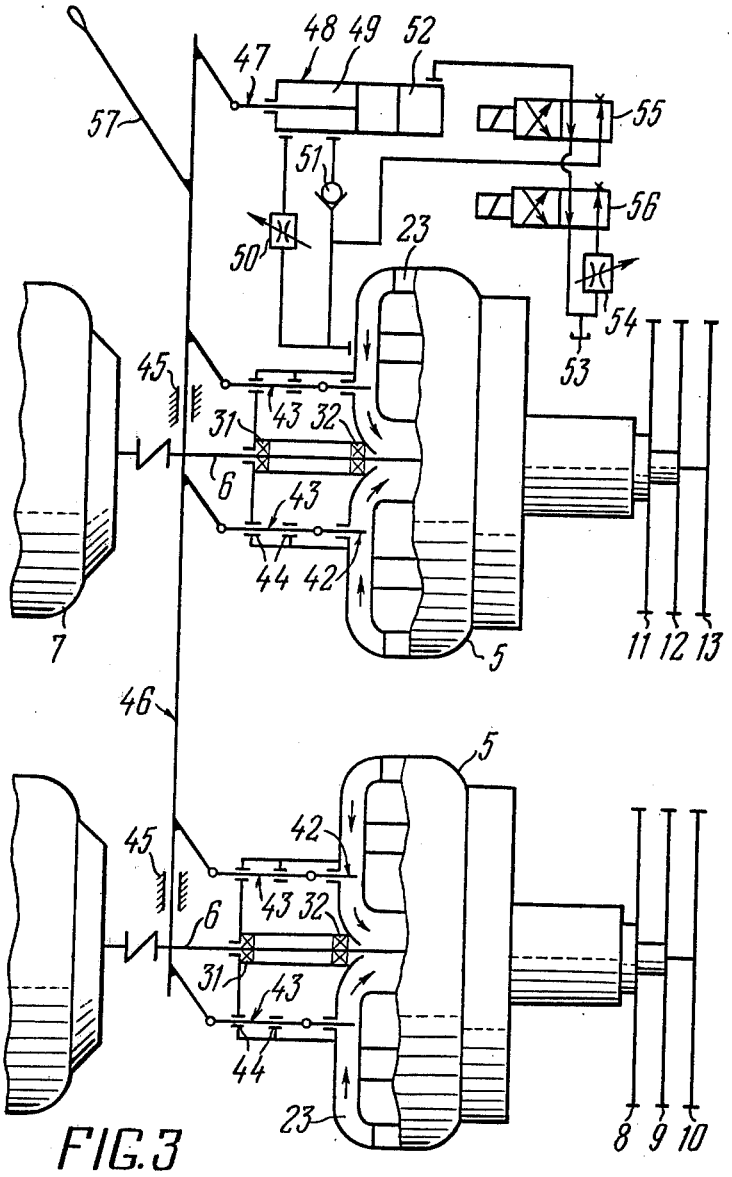
FIG. 3 is a partial plan view of a machine for multidie nonslip drawing of wire products with a partial section of multiturbine hydraulic transformers and with an electro-hydro-mechanical system for controlling valves of the hydraulic transformers.

The machine is ready for operation. The machine is accelerated to the working drawing speed by switching on the solenoid of the two-position distribution valve 55 (FIG. 3). The liquid under pressure then flows from the cavity 23 of the multiturbine hydraulic transformer 5 into the cavity 52 of the hydraulic cylinder actuator 48, the liquid being displaced from the rod cavity 49 via the throttle valve 50, the adjustment thereof achieving the necessary rate of operation of the machine.

In case of a failure, the draw blocks are stopped by deenergizing the solenoid of the distribution valve 55, thus communicating the cavity 52 of the hydraulic cylinder actuator 48 with the discharge piping 53, the valves sharply shutting off the flow of the circulating liquid in the multiturbine hydraulic transformers 5 to break off the power input to the draw blocks 8, 9, 10, 11, 12 and 13.

Whenever it is necessary to stop the machine smoothly without rupturing the wire, the solenoid of the distribution valve 56 is energized, the solenoid of the distribution valve 55 being switched off simultaneously. In the process, the cavity 52 of the hydraulic cylinder actuator 48 is communicated with the discharge piping 53 via the throttle valve 54, and the hydraulic cylinder actuator 48 smoothly closes the annular valve 42 of the multiturbine hydraulic transformers 5. The desired deceleration rate of the draw blocks 8, 9, 10, 11, 12 and 13 is achieved by operating a corresponding throttle valve 54. The characteristics of each turbine wheel are selected in a manner to pull the wire through respective dies and to provide the necessary back-pull.

As the multiturbine hydraulic transformer is inherently automatic (automatic variation of speed on change of load), the negligible process variations of the load on the draw blocks during the course of operation result in a corresponding redistribution of speeds among said draw blocks without affecting the wire drawing process.

If the back-pull of the wire is to be changed (e.g., decreased), the adjusting throttle valve 36 (FIGS. 1 and 2) is opened with the annular valves 42 remaining in the previous position, a portion of the working liquid from the pump wheel 24 then being diverted along the bypass piping 33 toward the pipings 34 and 35 and further on to the turbine wheels 26 and 27, while bypassing the turbine wheel 25. As a result, the power input is redistributed among the turbine wheels 25, 26 and 27 in a manner that the power supplied to the turbine wheel 25 decreases and that supplied to the turbine wheels 26 and 27 increases.

The redistribution of power between the turbine wheels 26 and 27 is governed by the magnitude of the flow area of the throttle valves 37 and 38. The redistribution of power among the turbine wheels 25, 26 and 27 results in a drop in the pulling force of the draw blocks 10 and 13 and in an increase of said force on the draw blocks 8 and 11 with the effect that the back-pull of the wire 73 falls off on all the drums. The closing of the regulating throttle valve 36 increases the back-pull of the wire.

Since the three turbine wheels of a single unit are controlled by a single annular valve, the control of the machine is substantially simplified, whereas the use of a multiturbine hydraulic transformer in combination with a unitized arrangement of the draw blocks minimizes the overall dimensions of the machine and its requirements in metal because of a lesser number of both the drive electric motors and the transmissions.

A comparison of the performance parameters of the machine according to the invention with those of the prior-art machine for similar application indicates that the floorspace and the metal requirements are diminished 2 and 3 times respectively, whereas the cost of the proposed machine is lower by a factor of two.

According to the invention, there may be provided machines of various types and sizes for multiturbine nonslip drawing or wire on draw blocks and also ones which may be substituted for some types of slip wire-drawing machines.

The proposed electro-hydro-mechanical control of the machine draw block drive is a multifunctional means, sufficiently simple in design, convenient in service and usable for controlling drawing machines with hydrodynamic transmission.

The invariable total power input to the machine may be distributed among the individual draw blocks in a manner to obtain a required wire back-pull.

The uniform redistribution of the back-pull among all the draw blocks will be facilitated by the inherent automation properties of the hydraulic transformer, or the automatic adjustment of speed on variation of load.

The provision of bypass interturbine ducts and of a single common adjusting throttle valve in combination with the inherent automation properties of the hydraulic transformer makes it possible to change, simultaneously and proportionately, the back-pull of wire on all the draw blocks of the drawing machine, this expanding the technological potentialities thereof and substantially simplifying the control of the machine as compared to known drawing machines having electromechanically driven draw blocks and an individual adjustment of the wire back-pull on each draw block.

What is claimed is:

1. A machine for multidie nonslip drawing of wire products, comprising: a bed; a decoiling device placed upstream of said bed along the flow of the production process; a coiling device downstream of said bed along the flow of the production process; die-head blocks with dies mounted on said bed; at least one pair of hydrodynamic transmissions, each of the transmissions being a multiturbine hydraulic transformer secured on said bed; each of said transformers housing a plurality of coaxial shafts, each of said shafts mounted in bearings located between said shafts, the external bearings being mounted in the housing of said multiturbine hydraulic transformer; draw blocks grouped in units, the number thereof corresponding to that of the multiturbine hydraulic transformers, each of said draw blocks being secured on a respective one of said shafts and being placed coaxially one with respect to another in each unit; turbine wheels, the number thereof corresponding to that of the draw blocks in a unit, each wheel being secured individually on a respective of said shafts of the multiturbine hydraulic transformer; a drive motor geared to said multiturbine hydraulic transformer.

2. A machine for multidie nonslip drawing of wire products as claimed in claim 1, wherein each of said multiturbine hydraulic transformers is provided with bypass pipings communicating one to another the inlets to the turbine wheels of said hydraulic transformer, said pipings incorporating adjusting throttle valves.

3. A machine for multidie nonslip drawing of wire products as claimed in claim 2, wherein said bypass pipings of one said multiturbine hydraulic transformer are connected to respective bypass pipings of another said multiturbine hydraulic transformer.

4. A machine for multidie nonslip drawing of wire products as claimed in claim 1, wherein each of said multiturbine hydraulic transformers is provided with a valve which shuts the flow of liquid in the working cavity thereof and has rods pivotally connected to a leverage geared to a rod of a hydraulic cylinder actuator, a rod cavity thereof communicating, via an adjusting throttle valve and a nonreturn valve, with the working cavity of one of said multiturbine hydraulic transformers, whereas a rodless cavity of said hydraulic cylinder actuator is connected, by means of two two-position distribution valves, to the same working cavity of said multiturbine hydraulic transformer and to a discharge piping, shut off by the adjusting throttle valve, and also directly to the discharge piping.

5. A machine for multidie nonslip drawing of wire products as claimed in claim 1, wherein a pin is provided in the housing of each of said multiturbine hydraulic transformers for stopping said draw blocks, said pin having an actuator for a reciprocating motion in slots made in disks of said turbine wheels.

6. A machine for multidie nonslip drawing of wire products as claimed in claim 1, wherein the body of each of said draw blocks incorporates dogs for gripping a wire, said dogs comprising clamping jaws, of which one is wedge-shaped and provided with a mechanism for a longitudinal motion in the direction for gripping the wire, and the second jaw is cylindrical with a transversal groove and is mounted in the body of said draw block for rotation about its longitudinal axis which is perpendicular to the direction of motion of the first jaw.

* * * * *